US009379494B1

(12) United States Patent
Hu et al.

(10) Patent No.: US 9,379,494 B1
(45) Date of Patent: Jun. 28, 2016

(54) ELECTRICAL CONNECTOR

(71) Applicant: LOTES CO., LTD, Keelung (TW)

(72) Inventors: Jin Ke Hu, Keelung (TW); Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/849,339

(22) Filed: Sep. 9, 2015

(30) Foreign Application Priority Data

May 26, 2015 (CN) ..... 2015 2 0344363 U

(51) Int. Cl.
*H01R 13/6594* (2011.01)
*H01R 13/6596* (2011.01)

(52) U.S. Cl.
CPC ..... *H01R 13/6594* (2013.01); *H01R 13/6596* (2013.01)

(58) Field of Classification Search
CPC ..... H01R 13/6594; H01R 13/6595; H01R 13/6596; H01R 13/6581; H01R 13/6587
USPC ..... 439/607.01, 607.07, 607.09, 607.11, 439/607.13, 607.23, 607.24, 607.26, 439/607.27, 607.31, 607.32, 607.36, 607.4, 439/607.53, 607.54, 607.56, 620.06, 439/620.12, 620.15, 620.16, 660, 541.5
See application file for complete search history.

(56) References Cited

U.S. PATENT DOCUMENTS

| | | | | |
|---|---|---|---|---|
| 7,748,999 | B1 * | 7/2010 | Sun | H01R 12/716 439/607.36 |
| 8,974,249 | B2 * | 3/2015 | Zhang | H01R 12/724 439/607.4 |
| 2002/0048992 | A1 * | 4/2002 | Wang | H01R 24/62 439/607.23 |
| 2007/0149053 | A1 * | 6/2007 | Wan | H01R 12/722 439/607.32 |
| 2009/0149045 | A1 * | 6/2009 | Chen | H01R 13/6471 439/92 |
| 2009/0286424 | A1 * | 11/2009 | Wang | H01R 27/02 439/607.23 |
| 2010/0136830 | A1 * | 6/2010 | Chen | H01R 13/504 439/607.01 |
| 2012/0282811 | A1 * | 11/2012 | Lin | H01R 43/20 439/626 |

* cited by examiner

*Primary Examiner* — Abdullah Riyami
*Assistant Examiner* — Harshad Patel
(74) *Attorney, Agent, or Firm* — Locke Lord LLP; Tim Tingkang Xia, Esq.

(57) ABSTRACT

An electrical connector includes an insulating body, upper row terminals and lower row terminals disposed in the insulating body, and a shielding casing placed on an outer side of the insulating body. The insulating body includes a base portion, and an elevated portion disposed below the base portion. Each of the terminals has a connecting portion located in the elevated portion. A shielding plate integrally extends from a bottom wall of the shielding casing to be located in front of the elevated portion. A back cover integrally bends from a top wall of the shielding casing to be located behind the elevated portion. When the electrical connector is soldered to a circuit board, the shielding plate and the back cover isolate the connecting portion from an external environment, so that the electrical connector is not affected by external electromagnetic interference (EMI) during transmission of high-frequency signals.

25 Claims, 6 Drawing Sheets

100

ELECTRICAL CONNECTOR

CROSS-REFERENCE TO RELATED APPLICATION

This non-provisional application claims priority under 35 U.S.C. §119(a) on Patent Application No. 201520344363.7 filed in P.R. China on May 26, 2015, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates generally to an electrical connector, and more particular to an electrical connector having a good high-frequency transmission performance.

BACKGROUND OF THE INVENTION

In the related art, an elevated type of electrical connector includes a body, multiple conducting terminals disposed in the body, and a metal casing disposed outside the body. The body includes a base portion, a tongue extending forward from the base portion, and an elevated portion extending downward from the base portion. Each of the conducting terminals has a contacting portion extending forward to the tongue, a soldering portion extending backward and out of the elevated portion, and a connecting portion disposed between the contacting portion and the soldering portion and located in the elevated portion. The metal casing includes a bottom plate, a top plate, and two side plates connecting the bottom plate and the top plate. The bottom plate, the top plate, and the two side plates surround the periphery of the tongue to form a mating space.

However, in an electrical connector of the foregoing structure, the connecting portion is located in the elevated portion. When the c electrical connector is soldered to a circuit board, since both a front side and a back side of the elevated portion lack shielding of the metal casing, the connecting portions are exposed to an external environment. Therefore, in a process of signal transmission, the exposed connecting portion causes that the electrical connector is easily affected by electromagnetic interference (EMI) in the external environment, thereby lowering high-frequency signal transmission quality thereof, which causes that the electrical connector cannot meet requirements on transmission of high-frequency signals.

Therefore, a heretofore unaddressed need exists in the art to address the aforementioned deficiencies and inadequacies.

SUMMARY OF THE INVENTION

In one aspect, the present invention relates to an electrical connector that can be effectively isolated from an external environment, thereby improving high-frequency transmission performance thereof.

In one embodiment, an electrical connector for being mounted on a circuit board, includes an insulating body, multiple terminals disposed in the insulating body, and a shielding casing disposed outside the insulating body. The insulating body has a base portion and a tongue protruding forward from the base portion. An elevated portion is disposed below the base portion, and the elevated portion is located above the circuit board. Each of the terminals has a connecting portion located in the elevated portion, and a soldering portion extending out of the elevated portion for being soldered to the circuit board. The shielding casing surrounds the tongue to form an insertion opening. The elevated portion is lower than the insertion opening. The shielding casing includes a bottom wall and a back cover. A shielding plate integrally extends from the bottom wall to be located in front of the elevated portion and at least partially shield the elevated portion. The back cover is located behind the elevated portion and at least partially shields the elevated portion.

In one embodiment, the connecting portion of each of the terminals is located between the shielding plate and the back cover.

In one embodiment, the shielding casing further includes a top wall and two side walls, the two side walls are connected to the top wall and the bottom wall, two baffles extend from the two side walls to be respectively located on two sides of the elevated portion, and the back cover bends and extends from the top wall.

In one embodiment, the shielding plate, the back cover, and the two baffles surround the connecting portions.

In one embodiment, at least one of the shielding plate, the back cover, and the baffle is provided with one or more soldering leg for being soldered to the circuit board.

In one embodiment, a cushion block is disposed below the bottom wall corresponding to the elevated portion, and the shielding plate is disposed between the cushion block and the elevated portion.

In one embodiment, an extending sheet is disposed on the bottom wall close to the insertion opening, and the extending sheet is provided with one or more insertion legs for being soldered to the circuit board.

In one embodiment, the multiple terminals include upper row terminals and lower row terminals, and the upper row terminals or the lower row terminals include multiple ground terminals, multiple signal terminals, and multiple power source terminals.

In one embodiment, the electrical connector further includes a shielding sheet disposed in the insulating body and located between the upper row terminals and the lower row terminals.

In one embodiment, the shielding sheet is provided with at least one protruding portion contacting at least one of the ground terminals.

In one embodiment, the shielding sheet is provided with an extending portion, and the extending portion at least partially extends to the elevated portion and is located between the connecting portions of the upper row terminals and the connecting portions of the lower row terminals.

In one embodiment, the shielding sheet is provided with at least an urging portion protruding the base portion and contacting the shielding casing.

In one embodiment, the electrical connector further includes a shielding sleeve sleeved over a position of the tongue that is close to the base portion and partially extending to the base portion, and the shielding sleeve is provided with at least an elastic arm urging the shielding casing.

In one embodiment, the shielding sheet contacts and is electrically connected to the shielding sleeve.

In one embodiment, the shielding sleeve is further provided with at least an elastic sheet urging at least one of the ground terminals.

In one embodiment, the position of the tongue close to the base portion is provided with at least a material escaping slot, a portion of the at least one of the ground terminals is exposed from the material escaping slot, and the elastic sheet urges the corresponding one of the ground terminals through the material escaping slot.

In one embodiment, the shielding casing includes a first shielding casing and a second shielding casing, the second shielding casing wraps the first shielding casing, the shielding plate integrally extends from the first shielding casing, and the back cover integrally extends from the second shielding casing.

In another aspect, the present invention relates to an electrical connector that can be effectively isolated from an external environment, thereby improving high-frequency transmission performance thereof.

In one embodiment, an electrical connector for being mounted on a circuit board, includes an insulating body, multiple terminals disposed in the insulating body, and a shielding casing placed outside the insulating body. The insulating body has a base portion and an elevated portion disposed below the base portion. The elevated portion is located above the circuit board. Each of the terminals has a contacting portion extending out of the base portion forward, a connecting portion extending backward from the contacting portion and located in the elevated portion, and a soldering portion extending out of the elevated portion for being soldered to the circuit board. The shielding casing forms an insertion opening. The elevated portion is lower than the insertion opening. The shielding casing includes a bottom wall and a back cover. A shielding plate integrally extends from the bottom wall to be located in front of the elevated portion and at least partially shield the elevated portion. The back cover is located behind the elevated portion and at least partially shields the elevated portion.

In one embodiment, the connecting portion is located between the shielding plate and the back cover.

In one embodiment, the shielding casing further includes a top wall and two side walls, the two side walls are connected to the top wall and the bottom wall, two baffles extend from the two side walls to be respectively located on two sides of the elevated portion, and the back cover bends and extends from the top wall.

In one embodiment, the shielding plate, the back cover, and the two baffles surround the connecting portions.

In one embodiment, at least one of the shielding plate, the back cover, and the baffle is provided with at least one soldering leg for being soldered to the circuit board.

In one embodiment, a cushion block is disposed below the bottom wall corresponding to the elevated portion, and the shielding plate is disposed between the cushion block and the elevated portion.

In one embodiment, an extending sheet is disposed on the bottom wall close to the insertion opening, and the extending sheet is provided with at least one insertion leg for being soldered to the circuit board.

In one embodiment, the shielding casing includes a first shielding casing and a second shielding casing, the second shielding casing wraps the first shielding casing, the shielding plate integrally extends from the first shielding casing, and the back cover integrally extends from the second shielding casing.

Compared with the related art, certain embodiments of the present invention, among other things, have the following beneficial effects. A shielding plate integrally extends from the shielding casing to be located in front of the elevated portion and at least partially shield the elevated portion, and at the same time, a back cover is set to be located behind the elevated portion and at least partially shield the elevated portion, so that the connecting portions are arranged between the shielding plate and the back cover. When the electrical connector is soldered to the circuit board, the shielding plate and the back cover isolate the connecting portions from the external environment, so that the electrical connector is not affected by external EMI during transmission of high-frequency signals, thereby improving high-frequency transmission performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
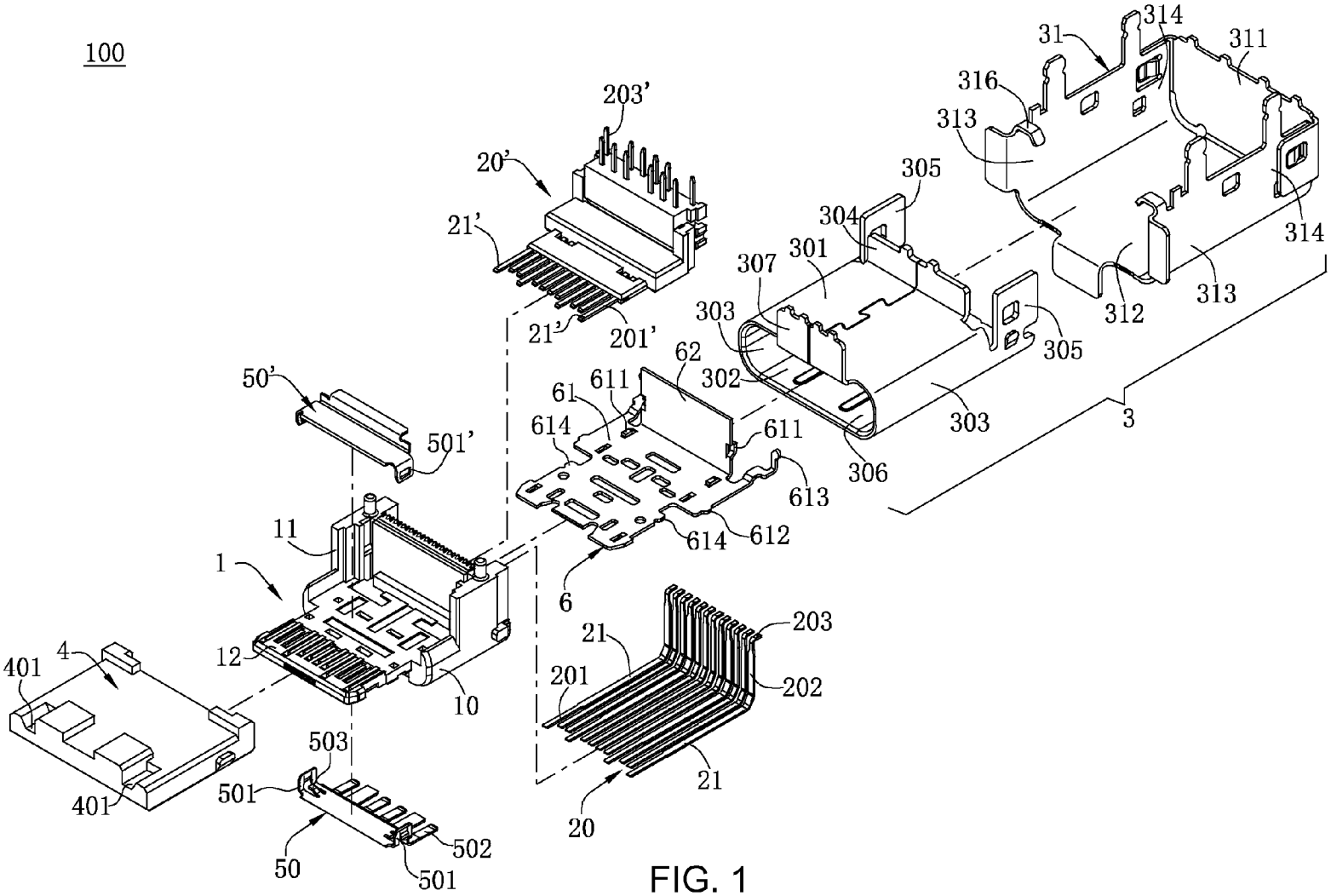
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 2:
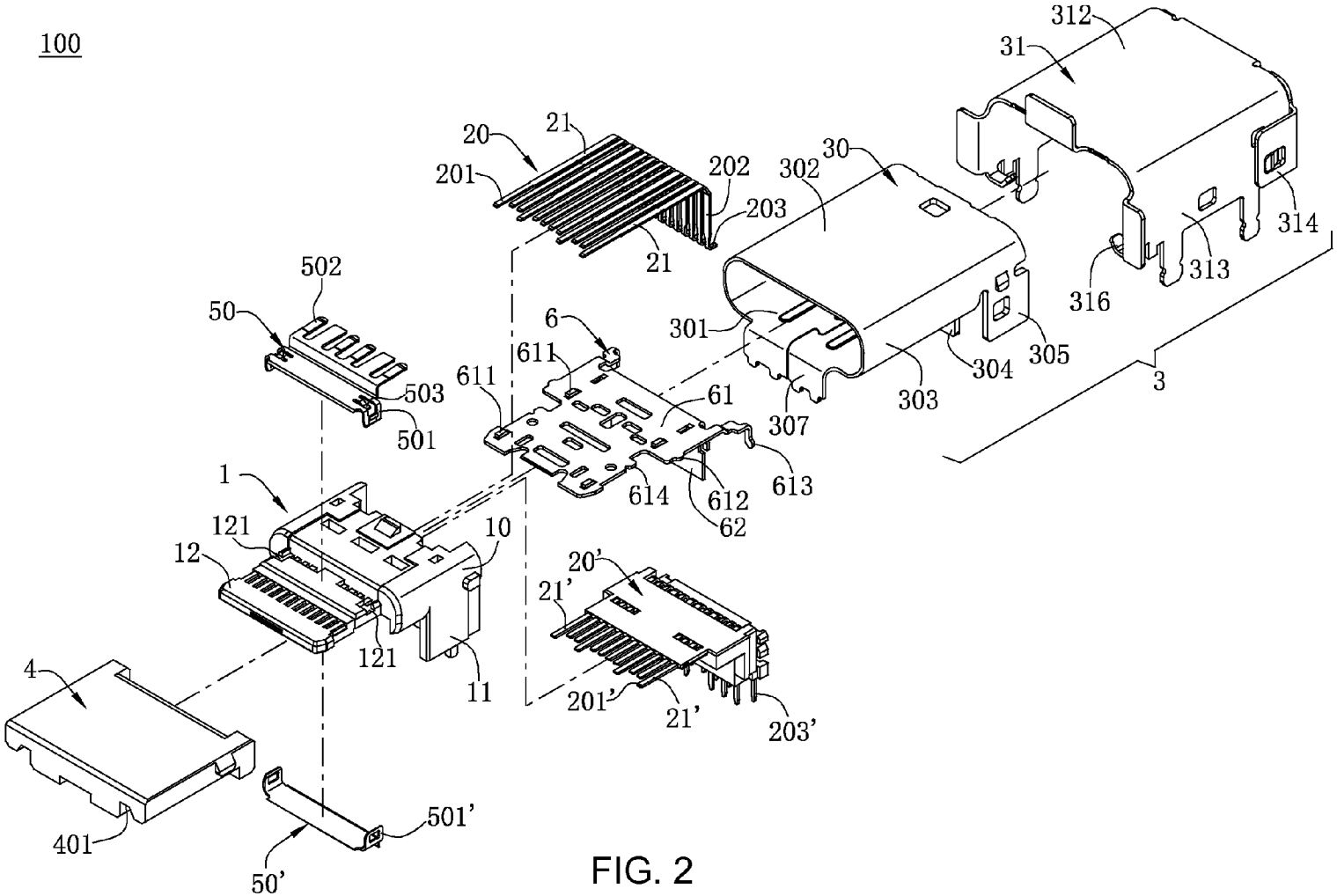
FIG. 2 is a schematic three-dimensional exploded view of an electrical connector from another angle according to one embodiment of the present invention.
Figure 3:
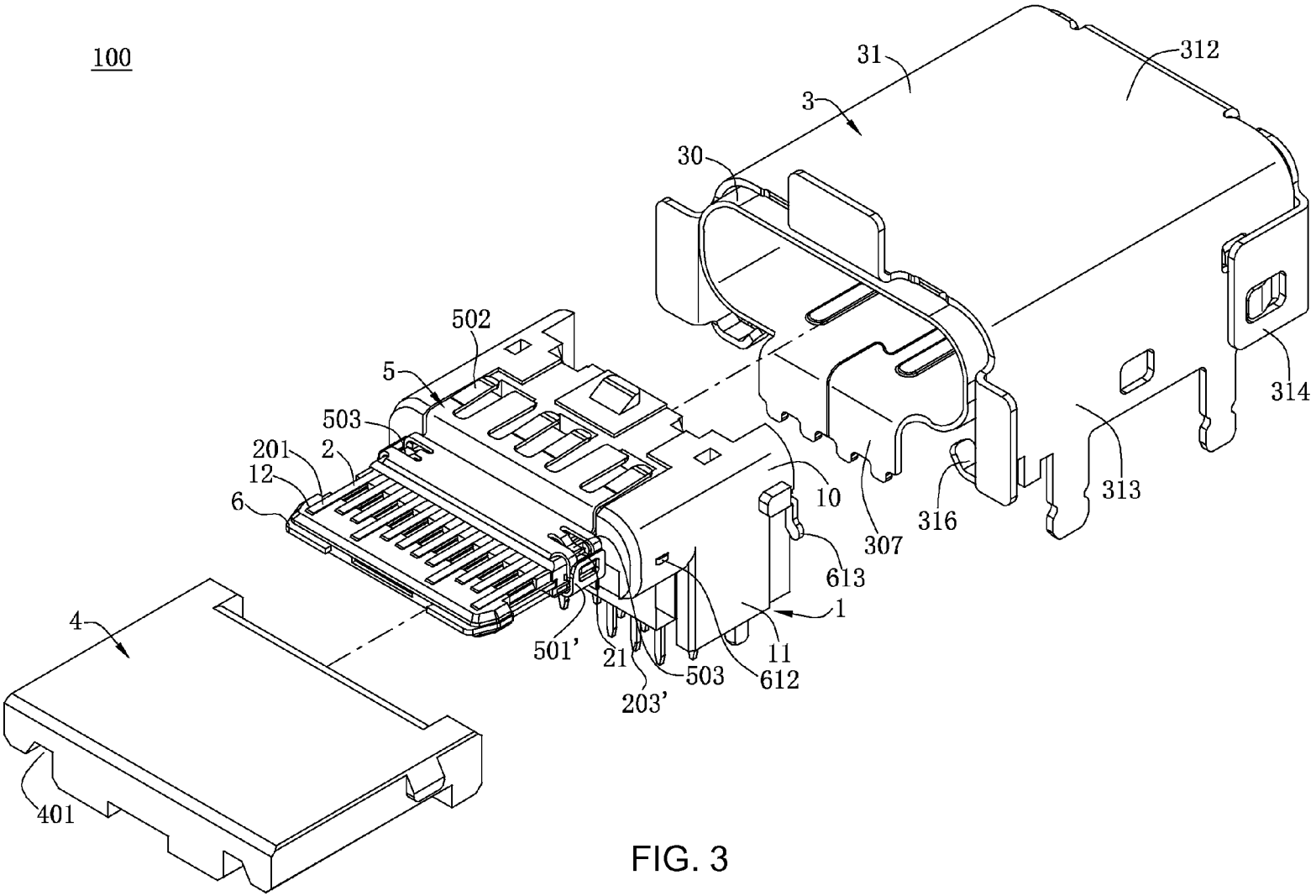
FIG. 3 is a schematic three-dimensional exploded view of a part of an electrical connector according to one embodiment of the present invention.

As shown in FIGS. 1, 2, and 3, an electrical connector 100 according to one embodiment of the present invention is used for being mounted on a circuit board 7. The electrical connector 100 includes an insulating body 1, multiple terminals 2, a shielding sheet 6, and a shielding casing 3. The multiple terminals 2 are divided into upper row terminals 20 and lower row terminals 20' fixedly disposed in the insulating body 1. The shielding sheet 6 is disposed in the insulating body 1 and located between the upper row terminals 20 and the lower row terminals 20'. The shielding casing 3 is placed on an outer side of the insulating body 1.

Figure 5:
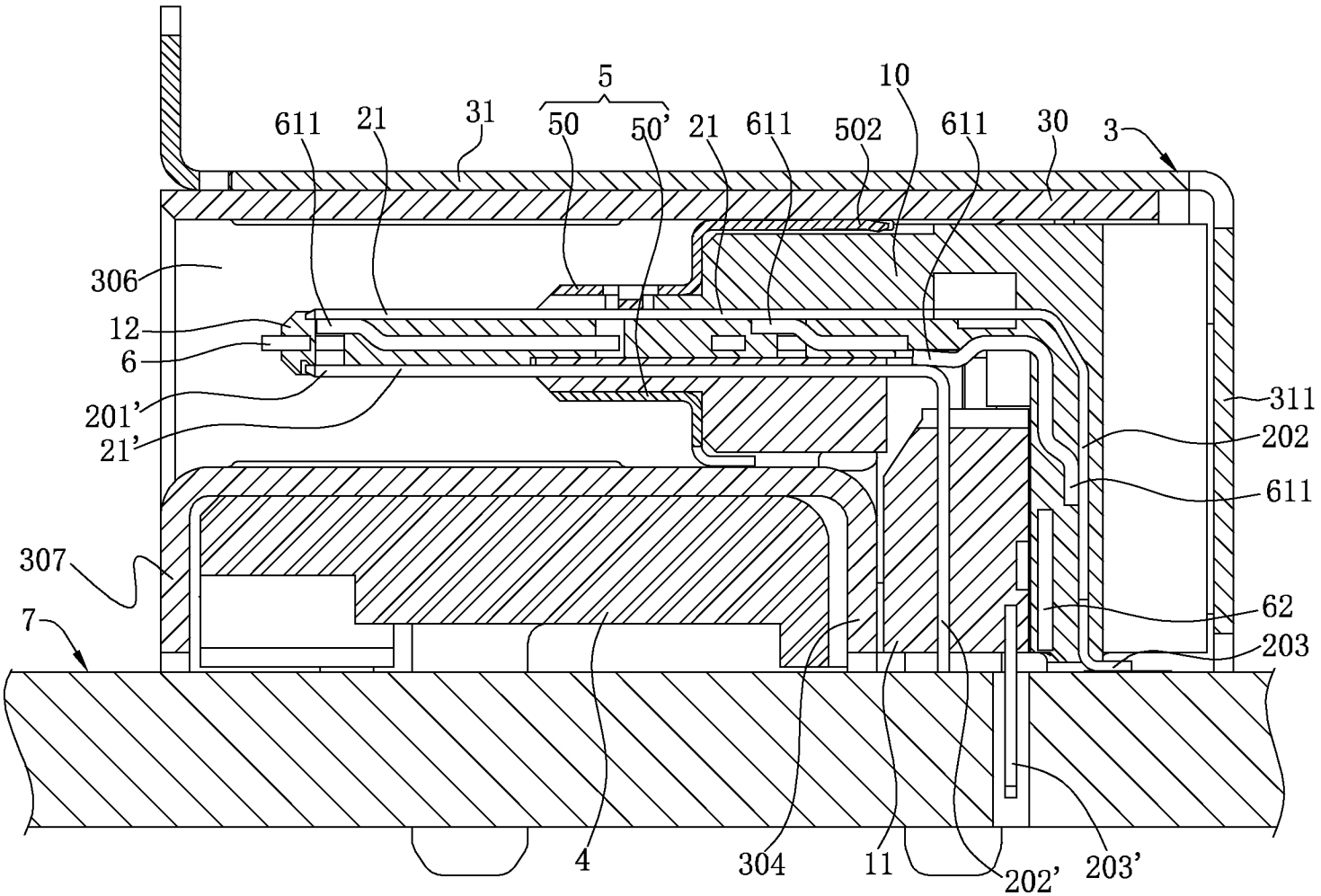
FIG. 5 is a side sectional view of an electrical connector according to one embodiment of the present invention.

As shown in FIGS. 2 and 5, the insulating body 1 includes a base portion 10, a tongue 12 protruding forward from the base portion 10, and an elevated portion 11 integrally extends below the base portion 10. The upper row terminals 20 and the lower row terminals 20' are respectively provided with contacting portions 201 and 201' extending forward to the tongue 12 and partially exposed from upper and lower surfaces of the tongue 12, and soldering portions 203 and 203' extending backward out of the elevated portion 11. Connecting portions 202 and 202' are connectedly disposed between the contacting portions 201 and 201' and the contacting portions 201 and 201', and the connecting portions 202 and 202' are located in the elevated portion 11. In one embodiment, the soldering portions 203 and 203' are arranged into three rows and soldered to the circuit board 7.

Figure 4:
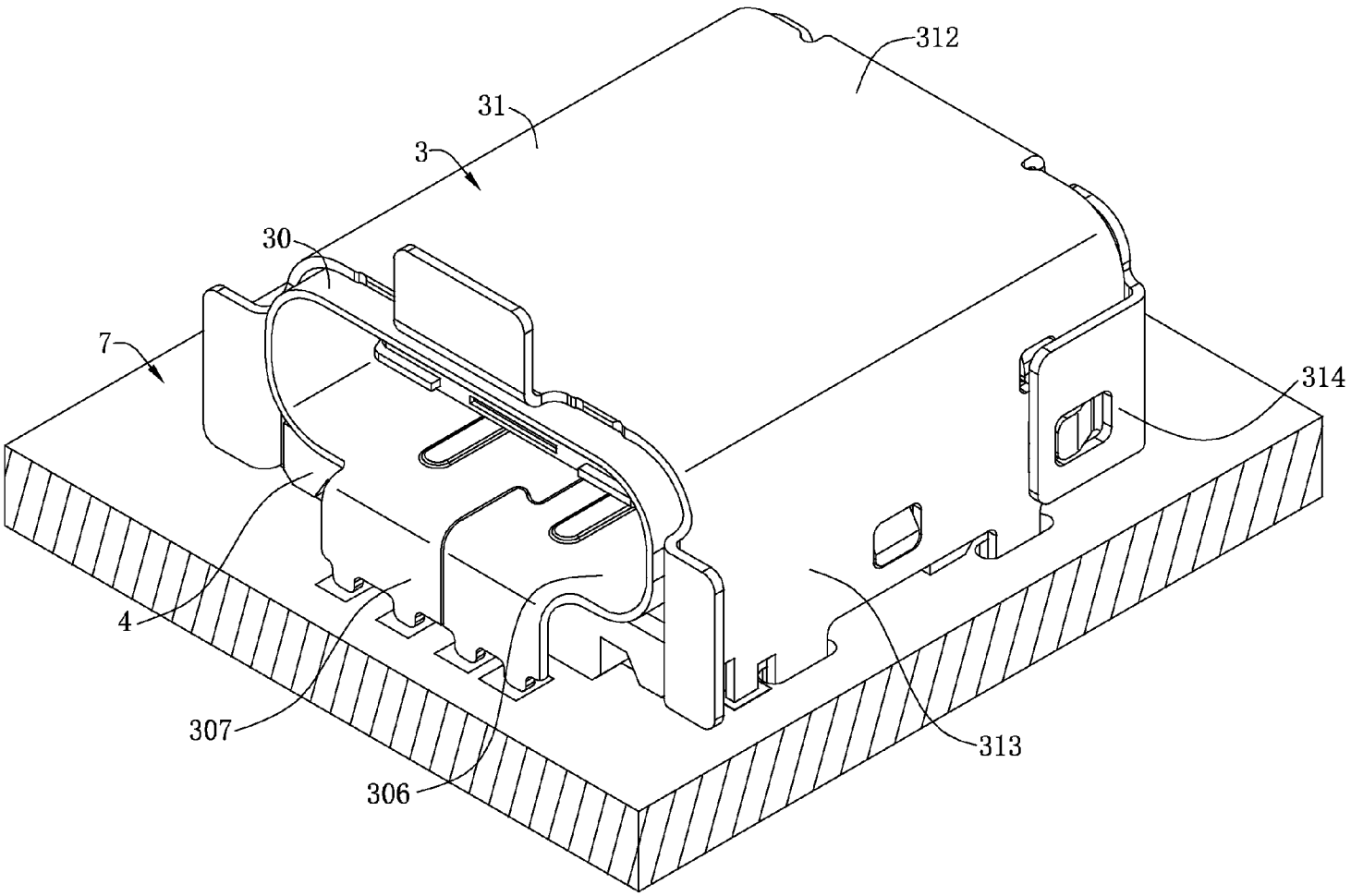
FIG. 4 is a schematic three-dimensional assembled view of an electrical connector according to one embodiment of the present invention.

As shown in FIGS. 2, 4, and 5, the shielding casing 3 includes a bottom wall 301, a top wall (302 and/or 312), and two side walls (303 and/or 313) connecting the bottom wall 301 and the top wall. The top wall, the bottom wall 301, and the two side walls surround the tongue 12 to form an insertion opening 306, and the elevated portion 11 is lower than the insertion opening 306. A shielding plate 304 integrally bends and extends downward from the bottom wall 301. The shielding plate 304 is located in front of the elevated portion 11, and at least partially shields the elevated portion 11. A back cover 311 integrally bends backward from the top wall. The back cover 311 is located behind the elevated portion 11, and at least partially shields the elevated portion 11. Thus, the connecting portions 202 and 202' are arranged between the shielding plate 304 and the back cover 311. Moreover, two baffles (305 and/or 314) extend from the two side walls to be respectively located on two sides of the elevated portion 11. The shielding plate 304, the back cover 311, and the two baffles surround the connecting portions 202 and 202'. When the electrical connector 100 is soldered to the circuit board 7, the shielding plate 304, the back cover 311, and the two baffles isolate the connecting portions 202 and 202' from an external environment, so that the electrical connector 100 is not affected by external EMI during transmission of high-frequency signals, thereby improving high-frequency transmission performance of the electrical connector 100. In one embodiment, one or more of the shielding plate 304, the back cover 311, and the baffles are provided with one or more soldering legs (not labeled) for being soldered to the circuit board 7, so as to strengthen a shielding effect of the electrical connector 100.

As shown in FIGS. 1, 2, and 4, in certain embodiments, the shielding casing 3 includes a first shielding casing 30 and a second shielding casing 31. The second shielding casing 31 wraps an outer side of the first shielding casing 30. The first shielding casing 30 includes the bottom wall 301, a first top wall 302, and two first side walls 303. The bottom wall 301, the first top wall 302, and the two first side walls 303 surround the tongue 12 to form the insertion opening 306. The shielding plate 304 integrally bends and extends downward from the bottom wall 301 of the first shielding casing 30 to be stopped in front of the elevated portion 11. The two first side walls 303 respectively extend to form the first baffles 305 to be located in the two sides of the elevated portion 11. The second shielding casing 31 includes a second top wall 312 and two second side walls 313 extending from two sides of the second top wall 312. The top walls includes the first top wall 302 and the second top wall 312, and the side walls includes the first side wall 303 and the second side wall 313. The second top wall 312 and the second side wall 313 respectively cover and attached to outer sides of the first top wall 302 and the first side wall 303. The back cover 311 integrally bends and extends backward from the second top wall 312 to be stopped behind the elevated portion 11. The baffles include a first baffle 305 and a second baffle 314. The second baffle 314 is formed by extending from the second side wall 313, and covers and attached to outer sides of the first baffle 305. In one embodiment, one or more soldering leg (not labeled) are disposed on the second baffle 314.

In certain embodiments, a cushion block 4 is disposed below the bottom wall 301. The cushion block 4 corresponds to the elevated portion 11 to fill a gap formed below the insertion opening 306, above the circuit board 7, and in front of the elevated portion 11, thereby clamping the shielding plate 304 between the elevated portion 11 and the cushion block 4, preventing the electrical connector 100 from falling forward after insertion and removing for multiple times, and prolonging a service life thereof. A front end of each of the second side wall 313 is provided with clamping hooks 316, and the cushion block 4 is correspondingly provided with notches 401. The clamping hooks 316 buckle the notches 401 respectively to fix the cushion block 4. In one embodiment, a front end of the bottom wall 301, integrally bending and extending, close to the insertion opening 306 is provided with an extending sheet 307. The cushion block 4 is fixed between the extending sheet 307 and the shielding plate 304. The extending sheet 307 integrally extending downward is provided with multiple insertion legs (not labeled) for being soldered to the circuit board 7, so as to enhance the grounding effect of the first shielding casing 30 and improve high-frequency transmission of the electrical connector 100. In one embodiment, the extending sheet 307 and the bottom wall 301 may also be formed separately, and the extending sheet 307 is fixed to the bottom wall 301 by means of soldering or in another manner, to which it is not limited.

As shown in FIGS. 1 and 2, each of the upper row terminals 20 and the lower row terminals 20' include 12 terminals. The upper row terminals 20 and the lower row terminals 20' are arranged in a reversed left-to-right order and in a symmetrical upper-to-lower manner, and transmission signals are the same. An arrangement order of the upper row terminals 20 from left to right is sequentially: a ground terminal (GND) 21, a high-speed sending differential signal terminal pair (TX1+ and TX1−, that is, a USB3.0 terminal), a power source terminal (Vbus), a reservation terminal (CC1), a USB2.0 differential terminal pair (Dp1 and Dn1), a reservation terminal (SBU1), a power source terminal (Vbus), a high-speed receiving differential signal terminal pair (RX2+ and RX2−), and a ground terminal (GND) 21. An arrangement order of the lower row terminals 20' from right to left is sequentially: a ground terminal (GND) 21', a high-speed sending differential signal terminal pair (TX2+ and TX2−, that is, a USB3.0 terminal), a power source terminal (Vbus), a reservation terminal (CC2), a USB2.0 differential terminal pair (Dp2 and Dn2), a reservation terminal (SBU2), a power source terminal (Vbus), a high-speed receiving differential signal terminal pair (RX1+ and RX1−), and a ground terminal (GND) 21'. Thus the electrical connector 100 can implement dual orientation insertion.

As shown in FIGS. 2 and 3, the electrical connector 100 further includes a shielding sleeve 5. The shielding sleeve 5 is sleeved over the position of the tongue 12 that is close to the base portion 10, and the shielding sleeve 5 partially extends to the base portion 10. The shielding sleeve 5 includes a first shielding sleeve 50 and a second shielding sleeve 50'. The first shielding sleeve 50 and the second shielding sleeve 50' buckle and combine with each other, and fixed to the position of the tongue 12 that is close to the base portion 10, by means of buckling portions 501 and 501'. The first shielding sleeve 50 has one or more elastic arms 502. The elastic arms 502 are located in the base portion 10, and elastically contact with the first top wall 302 of the first shielding casing 30 to achieve grounding. Moreover, two elastic sheets 503 are horizontally disposed from two sides of the first shielding sleeve 50, and the portion of the tongue 12 that is close to the base portion 10 corresponding to the elastic sheet 503 is provided with material escaping slots 121. The ground terminals 21 and 21' are partially exposed from the material escaping slots 121, and the elastic sheets 503 urge the corresponding ground terminals 21 and 21' through the material escaping slot 121 to achieve grounding, so as to strengthen the shielding effect of the electrical connector 100, thereby improving high-frequency transmission quality thereof. In another embodiment, the elastic sheets 503 may also be disposed in the second shielding sleeve 50', and the shielding sleeve 5 may also be formed integrally and sleeved over the tongue 12, to which it is not limited.

Figure 6:
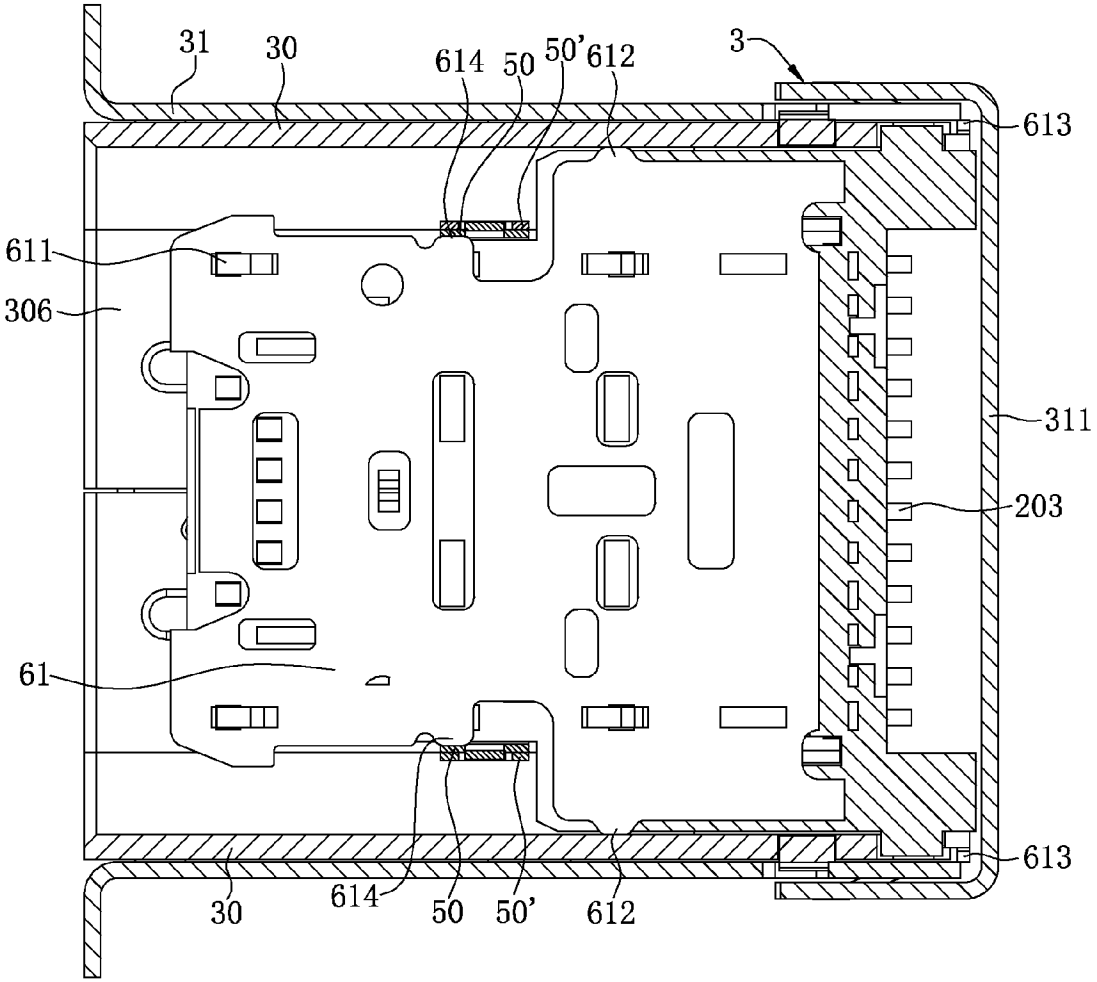
FIG. 6 is a top sectional view of an electrical connector according to one embodiment of the present invention.

As shown in FIGS. 2, 5, and 6, the shielding sheet 6 includes a plate body 61 and an extending portion 62. The plate body 61 is disposed in the tongue 12 and between the contacting portions 201 and 201' of the upper row terminals 20 and the lower row terminals 20'. The extending portion 62 extends backward from the plate body 61 and to the elevated portion 11, and is located between the connecting portions 202 and 202' of the upper row terminals 20 and the lower row terminals 20'. The plate body 61 and the extending portion 62 are respectively provided with multiple protruding portions 611 contacting the ground terminals 21 and 21', thereby enhancing the grounding effect of the electrical connector 100 and improving a high-frequency performance thereof. Further, two side edges of the plate body 61 are respectively extended with urging portions. The urging portion includes first urging portions 612 and second urging portions 613, and each of the second urging portions 613 is located behind the corresponding first urging portion 612. The first urging portions 612 protrude from the base portion 10 and respectively urge the first side wall 303 and the second side wall 313 of the first shielding casing 30. The second urging portions 613 extend backward from the two side edges of the plate body 61 along the base portion 10 first, and then bend downward and extend to be located in the two sides of the elevated portion 11 and elastically urging the second baffles 314 of the second shielding casing 31, so as to strengthen the grounding effect of the electrical connector 100. In one embodiment, the extending portion 62 may also be extended downward with one or more pins (not shown) for being soldered to the circuit board 7. Moreover, the two side edges of the plate body 61 corresponding to the shielding sleeve 5 are respectively provided with protrusions 614 protruding out of two sides of the tongue 12. The protrusions 614 urge against a junction of the buckling portions 501 and 501' of the first shielding sleeve 50 and the second shielding sleeve 50', thereby achieving the electrical connection between the shielding sheet 6 and the shielding sleeve 5.

In summary, the electrical connector 100 according to certain embodiments of the present invention, among other things, has the following beneficial advantages.

(1) The shielding plate 304 integrally bends and extends downward from the bottom wall 301. The shielding plate 304 is located in front of the elevated portion 11 and at least partially shields the elevated portion 11. The back cover 311 integrally bends backward from the second top wall 312. The back cover 311 is located behind the elevated portion 11 and at least partially shields the elevated portion 11. Thus the connecting portions 202 and 202' are arranged between the shielding plate 304 and the back cover 311. Moreover, two of the first side wall 303 and the second side wall 313 are respectively provided with the first baffle 305 and the second baffle 314 located on the two sides of the elevated portion 11. The shielding plate 304, the back cover 311, the first baffle 305, and the second baffle 314 surround the connecting portions 202 and 202', thereby isolating the connecting portions 202 and 202' from the external environment, so that the electrical connector 100 is not affected by external EMI during transmission of high-frequency signals, and high-frequency transmission performance of the electrical connector 100 is improved.

(2) The plate body 61 and the extending portion 62 are respectively provided with the multiple protruding portions 611 contacting the ground terminals 21 and 21', thereby enhancing the grounding effect of the electrical connector 100 and improving the high-frequency performance thereof. Further, the two side edges of the plate body 61 are respectively extended with the first urging portions 612 and the second urging portions 613. The first urging portions 612 protrude out of the base portion 10 and respectively urge the first side wall 303 of the first shielding casing 30. The second urging portions 613 extend backward from the two side edges of the plate body 61 along the base portion 10 first, and then bend and extend downward to be located in the two sides of the elevated portion 11 and elastically urging the second baffles 314 of the second shielding casing 31, so as to strengthen the grounding effect of the electrical connector 100.

(3) The two elastic sheets 503 are horizontally disposed on the two sides of the first shielding sleeve 50. The portion of the tongue 12 that is close to the base portion 10 is provided with the material escaping slots 121 corresponding to the elastic sheets 503. The ground terminals 21 and 21' are partially exposed from the corresponding material escaping slots 121. The elastic sheets 503 urge the corresponding ground terminals 21 and 21' through the material escaping slot 121 to achieve grounding, so as to strengthen the shielding effect of the electrical connector 100, thereby improving high-frequency transmission quality thereof.

(4) The two side edges of the plate body 61 corresponding to the shielding sleeve 5 are respectively provided with the protrusions 614 protruding out of the tongue 12. The protrusions 614 urge against the corresponding junctions between the buckling portions 501 and 501' of the first shielding sleeve 50 and the second shielding sleeve 50', thereby achieving electrical connection between the shielding sheet 6 and the shielding sleeve 5.

(5) The cushion block 4 is disposed below the bottom wall 301. The cushion block 4 corresponds to the elevated portion 11 to fill the gap formed below the insertion opening 306, above the circuit board 7, and in front of the elevated portion 11, thereby preventing the electrical connector 100 from falling forward after insertion and removing for multiple times and prolonging a service life thereof.

(6) The front end of the bottom wall 301 integrally bends and extends downward to form the extending sheet 307. The cushion block 4 is fixed between the extending sheet 307 and the shielding plate 304. The extending sheet 307 have one or more insertion legs (not labeled) for being soldered to the circuit board 7, so as to enhance the grounding effect of the first shielding casing 30 and improve high-frequency transmission of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for being mounted on a circuit board, comprising:

an insulating body, comprising a base portion, a tongue protruding forward from the base portion, and an elevated portion disposed below the base portion and located above the circuit board;

a plurality of terminals disposed in the insulating body, wherein each of the terminals has a connecting portion located in the elevated portion and a soldering portion extending out of the elevated portion for being soldered to the circuit board; and a shielding casing disposed outside the insulating body and surrounding the tongue to form an insertion opening, wherein the elevated portion is lower than the insertion opening, the shielding casing comprises a bottom wall and a back cover, a shielding plate integrally extends from the bottom wall to be located in front of the elevated portion and at least partially shields the elevated portion, and the back cover is located behind the elevated portion and at least partially shields the elevated portion.

2. The electrical connector according to claim 1, wherein the connecting portion of each of the terminals is located between the shielding plate and the back cover.

3. The electrical connector according to claim 1, wherein the shielding casing further comprises a top wall and two side walls, the two side walls are connected to the top wall and the bottom wall, two baffles extend from the two side walls to be respectively located on two sides of the elevated portion, and the back cover bends and extends from the top wall.

4. The electrical connector according to claim 3, wherein the shielding plate, the back cover, and the two baffles surround the connecting portions.

5. The electrical connector according to claim 3, wherein at least one of the shielding plate, the back cover, and the baffles is provided with at least one soldering leg for being soldered to the circuit board.

6. The electrical connector according to claim 1, wherein a cushion block is disposed below the bottom wall corresponding to the elevated portion, and the shielding plate is disposed between the cushion block and the elevated portion.

7. The electrical connector according to claim 1, wherein an extending sheet is disposed on the bottom wall close to the insertion opening, and the extending sheet is provided with at least one insertion leg for being soldered to the circuit board.

8. The electrical connector according to claim 1, wherein the plurality of terminals comprise upper row terminals and lower row terminals, and the upper row terminals or the lower row terminals comprise a plurality of ground terminals, a plurality of signal terminals, and a plurality of power source terminals.

9. The electrical connector according to claim 8, wherein the electrical connector further comprises a shielding sheet disposed in the insulating body and located between the upper row terminals and the lower row terminals.

10. The electrical connector according to claim 9, wherein the shielding sheet comprises at least one protruding portion contacting at least one of the ground terminals.

11. The electrical connector according to claim 9, wherein the shielding sheet is provided with an extending portion, and the extending portion at least partially extends to the elevated portion and is located between the connecting portions of the upper row terminals and the connecting portions of the lower row terminals.

12. The electrical connector according to claim 9, wherein the shielding sheet comprises at least one urging portion protruding from the base portion and contacting the shielding casing.

13. The electrical connector according to claim 9, wherein the electrical connector further comprises a shielding sleeve sleeved over a position of the tongue that is close to the base portion and partially extending to the base portion, and the shielding sleeve has at least one elastic arm urging the shielding casing.

14. The electrical connector according to claim 13, wherein the shielding sheet contacts and is electrically connected to the shielding sleeve.

15. The electrical connector according to claim 13, wherein the shielding sleeve further has at least one elastic sheet urging at least one of the ground terminals.

16. The electrical connector according to claim 15, wherein the position of the tongue close to the base portion is provided with at least a material escaping slot, a portion of at least one of the ground terminals is exposed from the material escaping slot, and the elastic sheet urges corresponding one of the ground terminals through the material escaping slot.

17. The electrical connector according to claim 1, wherein the shielding casing comprises a first shielding casing and a second shielding casing, the second shielding casing wraps the first shielding casing, the shielding plate integrally extends from the first shielding casing, and the back cover integrally extends from the second shielding casing.

18. An electrical connector used for being mounted on a circuit board, comprising:

an insulating body, comprising a base portion and an elevated portion disposed below the base portion and located above the circuit board;

a plurality of terminals disposed in the insulating body, wherein each of the terminals comprises a contacting portion extending out of the base portion forward, a connecting portion extending backward from the contacting portion and located in the elevated portion, and a soldering portion extending out of the elevated portion for being soldered to the circuit board; and a shielding casing placed outside the insulating body and forming an insertion opening, wherein the elevated portion is lower than the insertion opening, the shielding casing comprises a bottom wall and a back cover, a shielding plate integrally extends from the bottom wall to be located in front of the elevated portion and at least partially shields the elevated portion, and the back cover is located behind the elevated portion and at least partially shields the elevated portion.

19. The electrical connector according to claim 18, wherein the connecting portion of each of the terminals is located between the shielding plate and the back cover.

20. The electrical connector according to claim 18, wherein the shielding casing further comprises a top wall and two side walls, the two side walls are connected to the top wall and the bottom wall, two baffles extend from the two side walls to be respectively located on two sides of the elevated portion, and the back cover bends and extends from the top wall.

21. The electrical connector according to claim 20, wherein the shielding plate, the back cover, and the two baffles surround the connecting portions.

22. The electrical connector according to claim 21, wherein at least one of the shielding plate, the back cover, and the baffle is provided with at least one soldering leg for being soldered to the circuit board.

23. The electrical connector according to claim 18, wherein a cushion block is disposed below the bottom wall corresponding to the elevated portion, and the shielding plate is disposed between the cushion block and the elevated portion.

24. The electrical connector according to claim 18, wherein an extending sheet is disposed on the bottom wall close to the insertion opening, and the extending sheet is provided with at least one insertion leg for being soldered to the circuit board.

25. The electrical connector according to claim 18, wherein the shielding casing comprises a first shielding casing and a second shielding casing, the second shielding casing wraps the first shielding casing, the shielding plate integrally extends from the first shielding casing, and the back cover integrally extends from the second shielding casing.

* * * * *